US009282782B2

(12) United States Patent
Ko et al.

(10) Patent No.: US 9,282,782 B2
(45) Date of Patent: Mar. 15, 2016

(54) WATERPROOF SOLE WITH HIGH AIR AND VAPOR PERMEABILITY

(75) Inventors: Wai Yip Ko, Hong Kong (HK); Siu Ching Fung, Hong Kong (HK); Chun Ning Fong, Hong Kong (HK)

(73) Assignee: WEALTH LEADER ENTERPRISE LTD., Hong Kong (HK)

( * ) Notice: Subject to any disclaimer, the term of this patent is extended or adjusted under 35 U.S.C. 154(b) by 637 days.

(21) Appl. No.: 13/090,280

(22) Filed: Apr. 20, 2011

(65) Prior Publication Data

US 2012/0266494 A1 Oct. 25, 2012

(51) Int. Cl.

| | |
|---|---|
| ***A43B 5/00*** | (2006.01) |
| ***A43B 23/00*** | (2006.01) |
| ***A43B 7/08*** | (2006.01) |
| ***A43B 17/08*** | (2006.01) |
| ***A43B 7/06*** | (2006.01) |
| ***A43B 13/18*** | (2006.01) |
| ***A43B 1/02*** | (2006.01) |
| ***A43B 23/02*** | (2006.01) |
| ***A43B 7/12*** | (2006.01) |
| ***A43B 13/00*** | (2006.01) |

(52) U.S. Cl.

CPC ..... *A43B 7/087* (2013.01); *A43B 7/125* (2013.01); *A43B 13/00* (2013.01); *A43B 17/08* (2013.01); *A43B 23/022* (2013.01)

(58) Field of Classification Search

CPC ..... A43B 7/12; A43B 7/125; A43B 13/04; A43B 13/14; A43B 23/022

USPC ..... 36/84, 3 R, 3 B, 25 R, 30 R

See application file for complete search history.

(56) References Cited

U.S. PATENT DOCUMENTS

| | | | | | |
|---|---|---|---|---|---|
| 2,751,692 | A * | 6/1956 | Cortina | A43B 7/06 | 36/3 B |
| 4,438,573 | A * | 3/1984 | McBarron | A43B 7/081 | 36/29 |
| 4,808,469 | A * | 2/1989 | Hiles | A41D 31/0044 | 36/44 |
| 5,044,096 | A * | 9/1991 | Polegato | A43B 7/08 | 36/103 |
| 5,584,130 | A * | 12/1996 | Perron | A43B 7/1455 | 36/3 B |
| 5,619,809 | A * | 4/1997 | Sessa | 36/3 R | |
| 5,983,524 | A * | 11/1999 | Polegato | A43B 7/08 | 36/3 R |
| 6,389,711 | B1 * | 5/2002 | Polegato | A43B 7/08 | 36/3 B |
| 6,508,015 | B1 * | 1/2003 | Rauch | A43B 7/06 | 36/3 B |
| 6,655,048 | B2 * | 12/2003 | Moretti | A43B 7/125 | 36/29 |
| 6,681,500 | B2 * | 1/2004 | Moretti | A43B 7/08 | 36/3 B |
| 6,823,609 | B2 * | 11/2004 | Moretti | A43B 7/06 | 36/3 B |
| 6,976,319 | B2 * | 12/2005 | Pfander | A43B 1/0009 | 36/3 B |

(Continued)

OTHER PUBLICATIONS

V.N. Morris and J. N. Street, Permeability of Rubber to air: I—Effect of Temperature, Pressure, and Humidity, Dec. 1929, Industrial and Engineering Chemistry, pp. 1215-1219.*

*Primary Examiner* — Robert J Hicks
*Assistant Examiner* — Cameron A Carter

(57) ABSTRACT

A waterproof sole with high air and vapor permeability includes an upper layer made of breathable and waterproof material, a lower layer made of breathable and waterproof material, a shaped supporting layer made of rubber material between the upper layer and lower layer, and an outsole layer made of rubber material below the lower layer. A hollow space and a plurality of channels are connected to the bottom surface of the upper layer. A plurality of supporting projections are provided at a bottom surface of the supporting layer. A plurality of through-holes and inter-connected horizontal channels are provided in the outsole layer.

6 Claims, 4 Drawing Sheets

(56) References Cited

U.S. PATENT DOCUMENTS 7,096,604 B2 * 8/2006 Polegato Moretti ..... A43B 1/04 36/25 R
7,367,141 B2 * 5/2008 Polegato Moretti ... A43B 13/16 36/3 B
7,370,382 B2 * 5/2008 Polegato Moretti ..... A43B 7/06 12/142 T
7,546,697 B2 * 6/2009 Polegato Moretti ..... A43B 7/06 36/3 B
7,559,157 B2 * 7/2009 Polegato Moretti ... A43B 3/128 36/3 B
7,762,008 B1 * 7/2010 Clark ..... A43B 3/00 36/3 B
7,823,297 B2 * 11/2010 Polegato Moretti ... A43B 7/125 36/12
7,918,041 B2 * 4/2011 Cho ..... A43B 7/081 36/28
8,127,465 B2 * 3/2012 Byrne ..... A43B 7/06 36/3 A
8,276,294 B2 * 10/2012 Polegato Moretti ... A43B 7/125 36/3 B
2002/0050075 A1 * 5/2002 Moretti ..... A43B 7/125 36/3 R
2002/0157278 A1 * 10/2002 Moretti ..... A43B 7/06 36/3 R
2003/0150131 A1 * 8/2003 McManus ..... A43B 7/144 36/28
2004/0006888 A1 * 1/2004 Moretti ..... A43B 7/06 36/3 B
2004/0163277 A1 * 8/2004 Saiz Zapata ..... A43B 7/08 36/3 B
2005/0126036 A1 * 6/2005 Wu ..... A43B 7/08 36/3 B
2006/0162183 A1 * 7/2006 Polegato Moretti ... A43B 13/16 36/3 B
2007/0011908 A1 * 1/2007 Huang ..... A43B 7/081 36/3 B
2008/0127519 A1 * 6/2008 Byrne ..... A43B 7/06 36/102
2008/0178496 A1 * 7/2008 Lin ..... A43B 7/125 36/30 R
2008/0209769 A1 * 9/2008 Polegato Moretti ... A43B 13/16 36/3 B
2008/0263905 A1 * 10/2008 Tai ..... A43B 13/12 36/25 R
2009/0056171 A1 * 3/2009 Lin ..... A43B 7/146 36/3 B
2009/0113767 A1 * 5/2009 Lee ..... A43B 1/0045 36/3 B
2009/0151203 A1 * 6/2009 Boyer ..... A43B 13/206 36/3 B
2009/0282704 A1 * 11/2009 Park ..... A43B 7/1425 36/3 B
2010/0011624 A1 * 1/2010 Polegato Moretti ... A43B 7/125 36/3 A
2010/0050471 A1 * 3/2010 Kim ..... A43B 7/081 36/29
2010/0115791 A1 * 5/2010 Russell ..... A43B 7/1415 36/28
2010/0146824 A1 * 6/2010 Sensini ..... 36/3 B

* cited by examiner

WATERPROOF SOLE WITH HIGH AIR AND VAPOR PERMEABILITY

FIELD OF THE INVENTION

The present invention relates to a waterproof sole with high air and vapor permeability.

BACKGROUND OF THE INVENTION

As is known to all, air permeability and water vapor permeability are two critical aspects that affect the comfortability of shoes. The water vapor and sweat in the shoes can be taken away by the air exchange. The exchange of air, water vapor, and heat between the in-shoe microenvironment and the outside environment has been the subject of quite a few inventions. All the efforts are trying to improve these exchange and therefore to reduce the moist in the microenvironment inside shoes and to improve their comfortbility.

U.S. Pat. No. 6,508,015 disclosed a breathable outsole for footwear, in which the outsole has a two-layer structure. The two-layer structure contains an elastic and water vapor-permeable inner layer and an outer layer that covers less than 70% of the inner layer. The breathing activity of outsole is provided by the microporous structure of inner layer and the configuration of outer layer. The configuration of outer layer is such that the surface of inner layer available for water vapor exchange is restricted as little as possible. A microporous structure of insole is achieved, for example, by a sintered plastic.

U.S. Pat. No. 6,655,048 disclosed a breathable and waterproof sole for shoes, which comprises, at least along part of its extension, a lower waterproof component, which constitutes the tread; an upper component, with a supporting structure which has chambers which are connected to openings at least on the upper face and the edge; a membrane which is impermeable to water and vapor-permeable and externally surrounds at least the outward-facing regions of the upper component. The lower and upper components and the membrane are joined so as to form a seal at least in the regions where water infiltration is possible.

A vapor-permeable and waterproof sole for shoes was disclosed in U.S. Pat. No. 6,681,500, which comprising: a lower flat element made of shaped rubber-like material, which has a hollow upper region delimited by a border with air passage openings which extend laterally with respect to the ground resting plane; an upper element; a membrane made of waterproof and vapor-permeable material, which is interposed between said lower and upper element at said hollow region; said lower and upper elements and said membrane being joined hermetically in the perimetric regions of mutual contact.

U.S. Pat. No. 7,367,141 disclosed a waterproof and breathable sole for shoes, having a structure including a supporting layer which, at least in a preset macroportion, is made of net, felt, or other diffusely perforated material. A membrane made of a material that is impermeable to water and permeable to water vapor is associated above the supporting layer at least in the one preset macroportion made of net, felt or other diffusely perforated material, which it covers. A tread made of plastic material, with at least one through macroperforation at the at least one preset macroportion made of net, felt or other diffusely perforated material, is joined hermetically to the membrane and to the supporting layer at least at the perimeter of the at least one macroportion made of net, felt or other diffusely perforated material.

Although the above-mentioned soles have been commercially available for years and are able to provide the exchange of heat and water vapor between the in-shoe microenvironment and outside environment, the problem for better air permeability still remains in the shoes with these kinds of soles. In the case of the above soles, the functions of air, water vapor, and heat exchange to outside environment cannot be realized with the desired rate and hence the comfortability is still limited due to the membrane water impermeable materials and the limited space for air and water vapor exchange. These waterproof membrane have the air permeability of 300.000 $kPa \cdot s \cdot m^{-1}$ to 700.000 $kPa \cdot s \cdot m^{-1}$.

SUMMARY OF THE INVENTION

Due to the problem of the prior art that the soles that only have limited air, water vapor, and heat exchanges, the objective of the present invention is hence to provide a waterproof sole with high air and vapor permeability.

The objective of the present invention is also to provide a shoe.

According to one aspect of the present invention, a waterproof sole with high air and vapor permeability is provided herein, which includes:

An upper layer made of breathable and waterproof material;

A lower layer made of breathable and waterproof material;

A shaped supporting layer made of rubber material between the upper layer and lower layer, the supporting layer having a hollow space, a plurality of channels, and a plurality of supporting projections; the plurality of supporting projections being at the bottom surface of the supporting layer;the plurality of channels connecting the bottom suraface to a top surface of the supporting layer and hence connecting the upper layer and the hollow space formed when the supporting layer and the outsole layer are integrated.

An outsole layer made of rubber material underneath the lower layer, the outsole layer having a plurality of through-holes and a plurality of horizontal channels on the upper side of the outsole layer inter-connecting the through-holes.

More advantageously, the upper layer and the lower layer are made of breathable and waterproof materials with the air permeability of 1.500 $kPa \cdot s \cdot m^{-1}$ to 300.000 $kPa \cdot s \cdot m^{-1}$.

Advantageously, the plurality of channels are perpendicular to the bottom surface of the supporting layer.

Advantageously, the plurality of supporting projections are perpendicular to the bottom surface of the supporting layer.

Advantageously, the plurality of supporting projections are supporting columns.

Advantageously, the plurality of through-holes are interconnected to each other with the plurality of horizontal channels on the upper side of the outsole layer.

More advantageously, the through-holes have their bottom ends at the bottom of outsole layer.

According to another aspect of the present invention, a shoe including the above-mentioned sole is also provided.

The waterproof sole with high air and vapor permeability according to the present invention has the improved structure which contains a hollow space in the sole, which makes the air and water vapor flow freely inside it, this free flow of air and vapor will facilitate the balance of the heat generated. Once the sole is depressed by the weight of the shoe wearer, because of the high pressure, the air and water vapor will be forced to pass through the highly air and vapor permeable waterproof material layer to the outside through the through-holes and inter-connecting horizontal channels. When the pressure is released, the fresh air from outside can be sucked into the hollow space through the through-holes and the connecting channels passing through the waterproof material layer due to the pressure difference. This way, the air, water vapor, and heat exchanges are more efficient.

The another advantage of the new design of the sole is that it can prevent the water pressure building up in the through-holes so as to largely improve the water resistance of the sole. It is well know that the distribution of the pressure of feet is non-uniform. When the sole is in contact with water, due to the pressure distribution, certain parts of the sole will have much higher pressure building up, such as those under metatarsals and heel, while other parts such as under the mid-foot would have much less pressure. Once the water pressure increases in the through-holes of the high pressure parts of the sole, water can be directed by the inter-connecting channels to the parts where the pressure is low and the water may even flow out of the outsole through the through-holes in those parts. As a result, the water pressure will not be built up. This way, the water resistance property of the sole can be significantly improved, even with the use of materials such as fluorochemicals surface treated textile fabrics.

In summary, the design of the sole currently described has the advantage of high air and vapor permeability and facilitate the heat exchange with outside environment. With such sole design, the comfortability of the shoe made with the sole would be largely improved. In addition, the design of the sole also prevents the water pressure build-up so that a wide variety of water resistant and water-repellent materials can be used.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
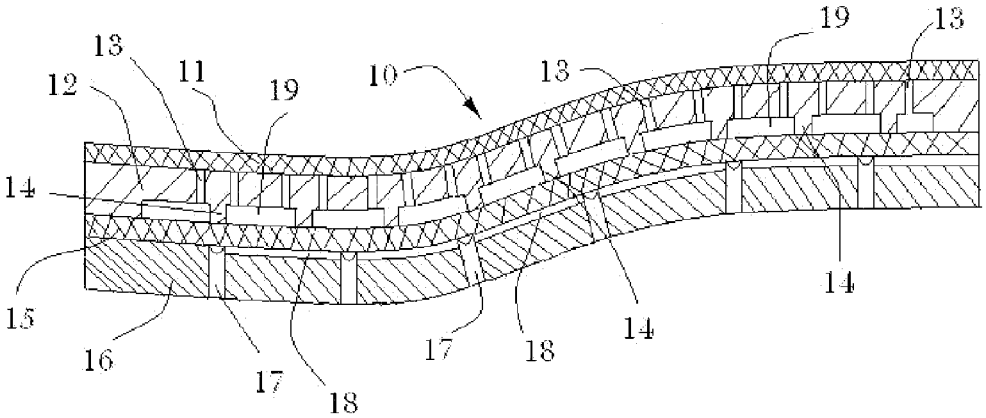
FIG. 1 is the cross-section view of the waterproof sole with high air and vapor permeability according to the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, the terms "comprising," "including," "having," "containing," "involving," and the like are to be understood to be open-ended, i.e., to mean including but not limited to.

Figure 2:
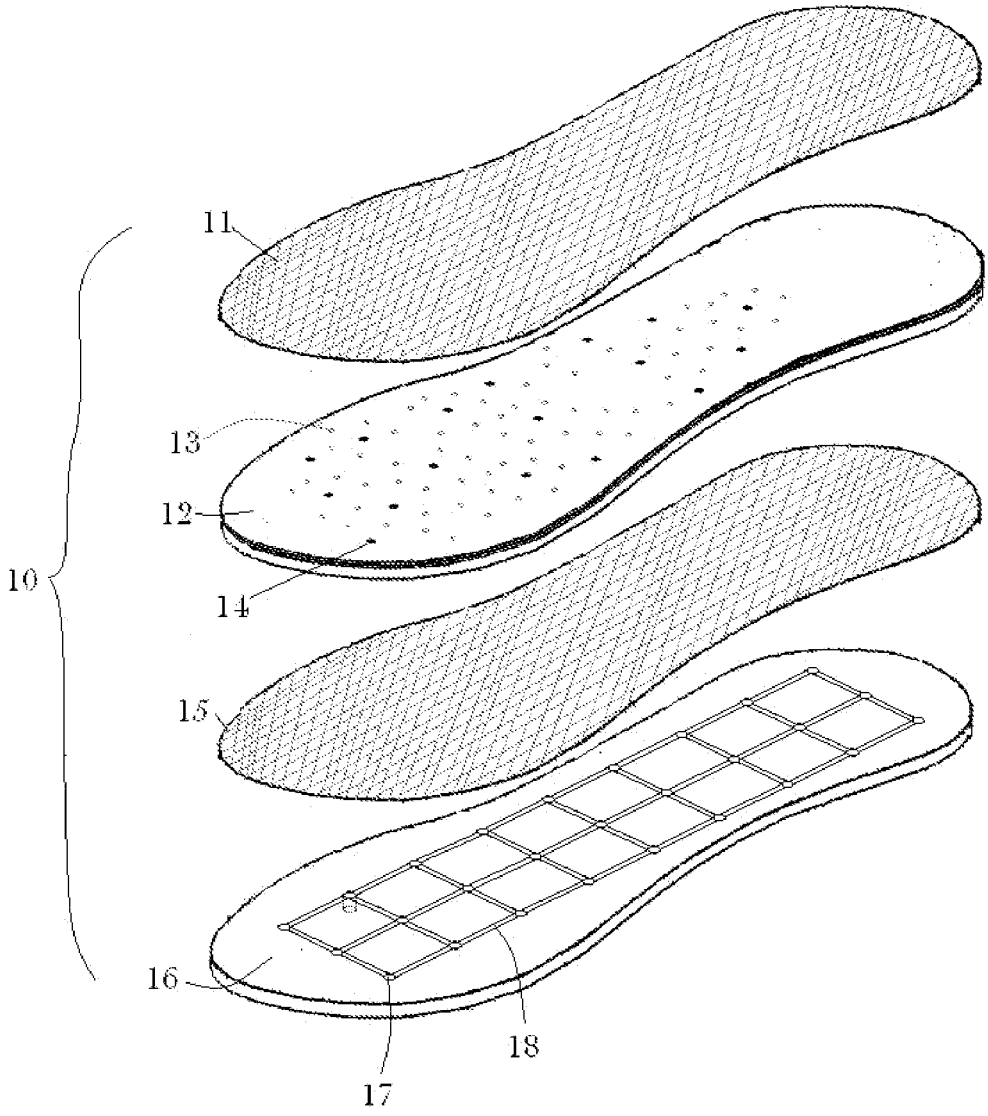
FIG. 2 is the exploding perspective view of the waterproof sole with high air and vapor permeability according to the present invention.
Figure 3:
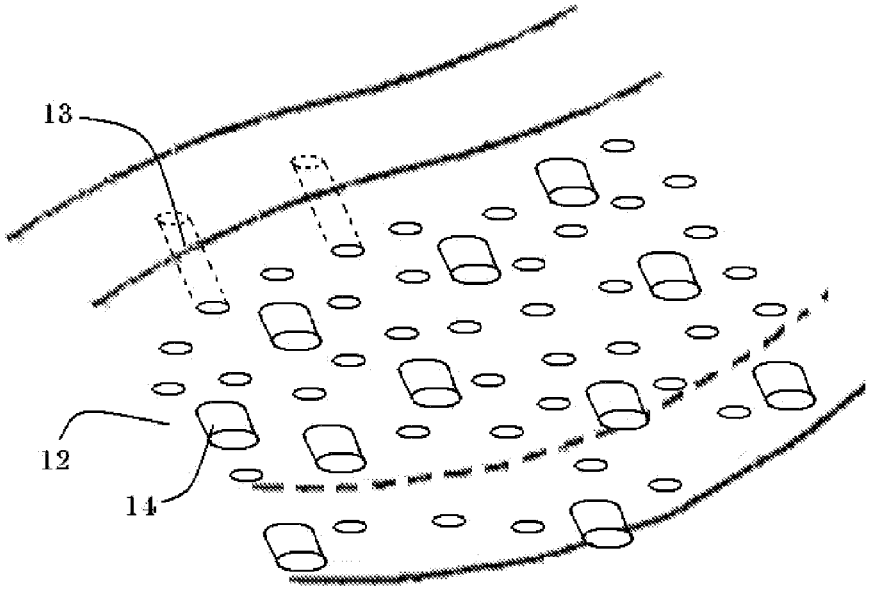
FIG. 3 is the bottom perspective view of the supporting layer.
Figure 4:
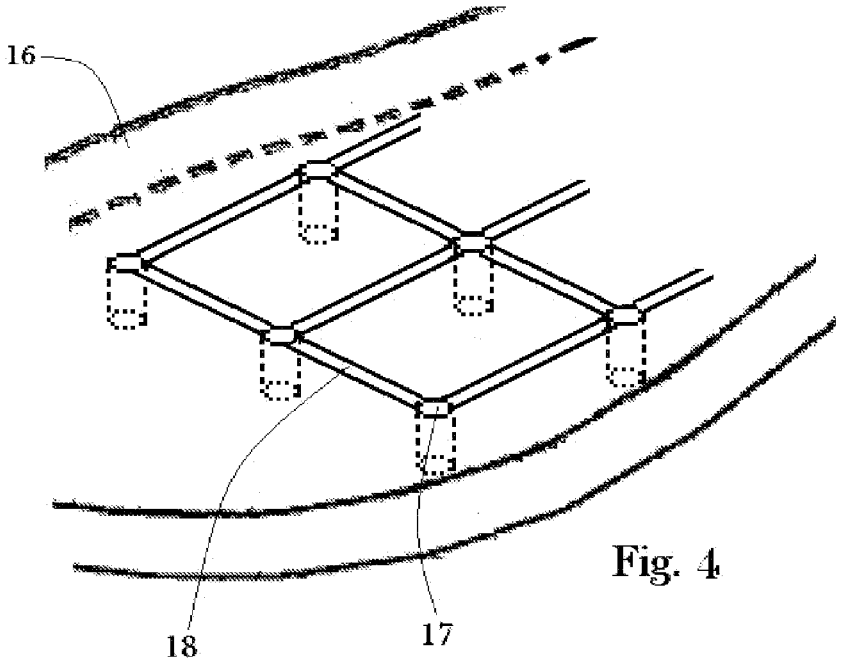
FIG. 4 is the top perspective view of the outsole layer.
Figure 5:
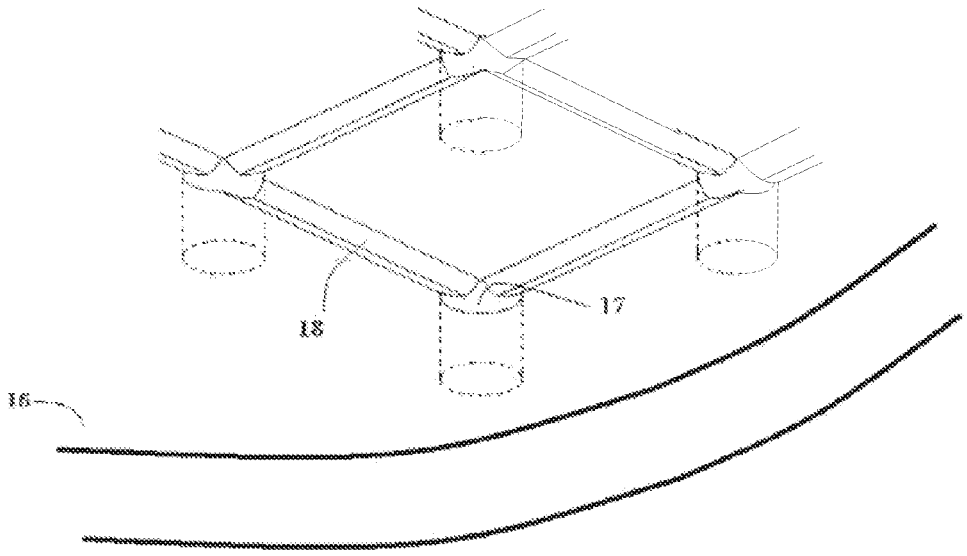
FIG. 5 is the top perspective view of the through-holes and the horizontal channel in the outsole layer.

FIG. 1 is the cross-section view of the waterproof sole with high air and vapor permeability according to the present invention, FIG. 2 is the exploding perspective view of the waterproof sole with high air and vapor permeability according to the present invention, FIG. 3 is the bottom perspective view of the supporting layer, FIG. 4 is the top perspective view of the outsole layer, FIG. 5 is the top perspective view of the through-holes and the horizontal channel in the outsole layer.

As shown in FIGS. 1 and 2, a waterproof sole with high air and vapor permeability 10 is depicted, which contains an upper layer 11, a lower layer 15, a shaped supporting layer 12 located between the upper layer 11 and the lower layer 15 and an outsole layer 16 below the lower layer 15. The upper layer 11 and/or lower layer 15 are made of breathable and waterproof material, for example, cotton fabrics or the polyester fabrics treated with low surface energy materials, such as fluorochemicals, silicone materials, wax, or any other materials with low surface energy and hydrophobic properties. More preferably, the breathable and waterproof materials have the air permeability of 1.500 $kPa \cdot s \cdot m^{-1}$ to 300.000 $kPa \cdot s \cdot m^{-1}$, much lower than the of waterproof materials used in prior art, so as to largely reduce the heat and water vapor building up in the shoe and hence improve the comfortability.

The shaped supporting layer 12 has a plurality of channels 13 therein, which connect the bottom surface to the top surface of the supporting layer 12 and hence connect the upper layer 11 and the hollow region 19 formed when the supporting layer 12 and the outsole layer 16 are integrated. Furthermore, the shaped supporting layer 12 also has a plurality of supporting projections 14, which are present in the hollow region 19 formed when the sole is integrated. Preferably, the channels 13 and the supporting projections 14 are both perpendicular to the bottom surface of the supporting layer 12, and are therefore substantially perpendicular to all the top and/or surface(s) of the upper layer 11, the lower layer 15, the supporting layer 12 and the outsole layer 16 at least in the certain small areas. More preferably, the supporting projections 14 are supporting columns that are perpendicular to the bottom surface of the supporting layer 12.

The outsole layer 16 is below the lower layer 15, and has a plurality of through-holes 17 therein. And the plurality of through-holes 17 are connected to each other with the plurality of horizontal channels 18 (see FIG. 4 and FIG. 5). Preferably, the bottom ends of the through-holes 17 are at the bottom of outsole layer (see FIG. 5). The supporting layer 12 and/or the outsole layer 16 are made of, for example, rubber material.

While integrated as one whole, the improved structure of the sole with high air and vapor permeability according to the present invention enhances the air exchange between the in-shoe microenvironment and the outside environment. The high air and vapor permeability through the sole is enabled, and therefore the in-shoe dry microenvironment can be kept and the odours are prevented to be produced.

The above-mentioned soles can be used in various kinds of shoes and improve the comfortability while people wearing the shoes.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A waterproof sole with high air and vapor permeability, wherein the sole includes:

an upper layer made of breathable and waterproof material;

a lower layer made of breathable and waterproof material;

a shaped supporting layer made of rubber material and arranged between the upper layer and lower layer, wherein the supporting layer comprises a hollow space defined at a lower part thereof with an opening supported on the lower layer, a plurality of supporting projections provided in the hollow space and protruded downwardly from the supporting layer to the opening, and a plurality of first channels running through an upper part of the supporting layer, and extending vertically from a bottom surface to a top surface of the upper part in a direction of gravity, and hence connecting the upper layer and the hollow space formed when the supporting layer and an outsole layer are integrated; wherein the plurality of first channels are perpendicular to the bottom surface of the supporting layer;

the outsole layer made of rubber material underneath the lower layer, the outsole layer having a plurality of through-holes extending in a direction parallel to the extending direction of the first channels; and a plurality of horizontal channels on an upper side of the outsole layer inter-connecting the through-holes; wherein bottom ends of the through-holes are at a bottom of the outsole layer;

wherein the plurality of supporting projections are perpendicular to the bottom surface of the supporting layer, such that an axis of each of the first channels and an axis of each of the supporting projections are substantially perpendicular to the upper layer, the lower layer, the supporting layer and the outsole layer at least; and the breathable and waterproof materials are cotton fabric or polyester fabric treated with low surface energy materials; and wherein the plurality of supporting projections are supporting columns.

2. The sole according to claim 1, wherein the upper layer and the lower layer are made of breathable and waterproof material with the air permeability of 1.500 $kPa \cdot s \cdot m^{-1}$ to 300.000 $kPa \cdot s \cdot m^{-1}$.

3. A waterproof sole with high air and vapor permeability, wherein the sole includes:

an upper layer made of breathable and waterproof material;

a lower layer made of breathable and waterproof material;

a shaped supporting layer made of rubber material and arranged between the upper layer and lower layer, wherein the supporting layer comprises a hollow space defined at a lower part thereof with an opening supported on the lower layer, a plurality of supporting projections provided in the hollow space and protruded downwardly from the supporting layer to the opening, and a plurality of first channels running through an upper part of the supporting layer, and extending vertically from a bottom surface to a top surface of the upper part in a direction of gravity, and hence connecting the upper layer and the hollow space formed when the supporting layer and an outsole layer are integrated; wherein the plurality of first channels are perpendicular to the bottom surface of the supporting layer;

the outsole layer made of rubber material underneath the lower layer, the outsole layer having a plurality of through-holes extending in a direction parallel to the extending direction of the first channels; and a plurality of horizontal channels on an upper side of the outsole layer inter-connecting the through-holes; wherein bottom ends of the through-holes are at a bottom of the outsole layer;

wherein the plurality of supporting projections are perpendicular to the bottom surface of the supporting layer, such that an axis of each of the first channels and an axis of each of the supporting projections are substantially perpendicular to the upper layer, the lower layer, the supporting layer and the outsole layer; and the breathable and waterproof materials are cotton fabric or polyester fabric treated with low surface energy materials; and wherein, the plurality of through-holes are inter-connected to each other with the plurality of horizontal channels.

4. A shoe, comprising: a waterproof sole with high air and vapor permeability including:

an upper layer made of breathable and waterproof material;

a lower layer made of breathable and waterproof material;

a shaped supporting layer made of rubber material and arranged between the upper layer and lower layer, wherein the supporting layer comprises a hollow space defined at a lower part thereof with an opening supported on the lower layer, a plurality of supporting projections provided in the hollow space and protruded downwardly from the supporting layer to the opening, and a plurality of first channels running through an upper part of the supporting layer, and extending vertically from a bottom surface to a top surface of the upper part in a direction of gravity, and hence connecting the upper layer and the hollow space formed when the supporting layer and an outsole layer are integrated; wherein the plurality of first channels are perpendicular to the bottom surface of the supporting layer;

the outsole layer made of rubber material underneath the lower layer, the outsole layer having a plurality of through-holes extending in a direction parallel to the extending direction of the first channels; and a plurality of horizontal channels on an upper side of the outsole layer inter-connecting the through-holes; wherein bottom ends of the through-holes are at a bottom of the outsole layer;

wherein the plurality of supporting projections are perpendicular to the bottom surface of the supporting layer, such that an axis of each of the first channels and an axis of each of the supporting projections are substantially perpendicular to the upper layer, the lower layer, the supporting layer and the outsole layer at least; and the breathable and waterproof materials are cotton fabric or polyester fabric treated with low surface energy materials; and wherein, the plurality of supporting projections are supporting columns.

5. The shoe according to claim 4, wherein, the upper layer and the lower layer are made of breathable and waterproof material with the air permeability of 1.500 $kPa \cdot s \cdot m^{-1}$ to 300.000 $kPa \cdot s \cdot m^{-1}$.

6. The shoe according to claim 4, wherein, the plurality of through-holes are inter-connected to each other with the plurality of horizontal channels.

* * * * *